United States Patent [19]

Manns et al.

[11] Patent Number: 4,681,239

[45] Date of Patent: Jul. 21, 1987

[54] HOLDER FOR CONTAINER FOR LIQUID

[75] Inventors: Michael C. Manns; Terry E. Roberts, both of Festus, Mo.

[73] Assignee: Roman Products, Inc., De Soto, Mo.

[21] Appl. No.: 894,379

[22] Filed: Aug. 7, 1986

[51] Int. Cl.[4] ..... B65D 23/08; B65D 81/38; A47J 41/00

[52] U.S. Cl. ..... 220/408; 150/52 R; 215/13 R; 215/100.5; 220/85 H; 220/903

[58] Field of Search ..... 220/408, 85 H, 903; 215/100.5, 13 R; 150/52 R

[56] References Cited

U.S. PATENT DOCUMENTS

| | | | |
|---|---|---|---|
| 2,324,253 | 7/1943 | Anderson | 215/13 R |
| 2,655,281 | 10/1953 | Davis | 215/100.5 |
| 3,103,295 | 9/1963 | Ghee | 215/100.5 |
| 3,120,319 | 2/1964 | Buddrus | 220/902 |
| 3,285,455 | 11/1966 | Pewitt | 215/100.5 |
| 3,725,188 | 4/1973 | Kalt | 206/813 |
| 3,899,098 | 8/1975 | Hutchins | 220/85 H |

*Primary Examiner*—George E. Lowrance
*Attorney, Agent, or Firm*—Rey Eilers

[57] ABSTRACT

An insulating holder, for a container for liquid, has an elongated, annular, side wall and a bottom which coact to define an elongated, generally-cylindrical recess which has an inner diameter that is larger than the diameter of that container. A rim is provided on the outer surface of the elongated annular side wall so it is, at least in part, axially in register with the annular recess. An annular sealing member of resilient cellular material has a radial dimension which is substantially greater than the radial dimension of the annular recess.

3 Claims, 3 Drawing Figures

HOLDER FOR CONTAINER FOR LIQUID

SUMMARY OF THE INVENTION

The present invention provides a holder, for a container for liquid, which can provide an angular dead-air space around that container, and which can provide a significant insulating effect for that container in addition to the insulating effect provided by that annular dead-air space. That holder has an open end to accommodate the bottom of that container; and an annular sealing member is provided adjacent that open end to engage the side of the container to limit free ingress of moisture-laden air into the annular dead-air space around that container. The open end of the holder is made large enough to accommodate the side of the largest-size container, of a given range of commercially available containers; and the annular sealing member is made small enough to engage the side of the smallest-size container in that range of containers. However, that annular sealing member is made sufficiently compressible in the radial direction to accommodate the largest-size container in that range of containers. As a result, the annular sealing member is able to span the annular gap between the inner surface of the holder and the side of the smallest-size container in a given range, as well as to span the annular gap between that inner surface and the side of the largest-size container in that range. It is, therefore, an object of the present invention to provide a holder, for a container for liquid, which can provide an annular dead-air space around that container and which has an annular sealing member that can span the annular gap between the inner surface of that holder and the side of the smallest-size container in a given range, as well as to span the annular gap between that inner side and the surface of the largest-size container in that range.

The annular sealing member, of the holder provided by the present invention, is able to accommodate a large-size container, and yet span the annular gap between the inner surface of that holder and the side of a small-size container; because that annular sealing member has a compressibility of at least sixteen percent (16%). Such a high compressibility enables an annular sealing member, which has a radial dimension of three-eighths of an inch thick when mounted within a holder, to span an annular gap of three-sixteenths (3/16) of an inch between the inner surface of that holder and the side of a two and nine-sixteenths (2 9/16) inch diameter container and yet also span an annular gap of one-quarter ($\frac{1}{4}$) of an inch between that inner surface and the side of a two and seven-sixteenths (2 7/16) inch diameter container. Because the difference between the radii of the largest and smallest generally-used metal containers for beer, soft drinks and fruit juices is only one-sixteenth (1/16) of an inch, the annular sealing member of the present invention can span the annular gap between the inner surface of the holder and the side of any of those containers. It is, therefore, an object of the present invention to provide an annular sealing member, for a holder for a container for liquid, which has a compressibility of at least sixteen percent (16%) in the radial direction.

The annular sealing member, of the holder provided by the present invention, has the outer portion thereof disposed within an annular recess in the inner surface of that holder adjacent the open end of that holder. The compressibility of that annular sealing member preferably is high enough to enable substantially all of that annular sealing member to be compressed into that annular recess; and, where that is the case, the inner diameter of that holder, and not the annular sealing member, is the limiting factor on the size of the container which can be introduced into that holder. It is, therefore, an object of the present invention to provide an annular recess in the inner surface of a holder for a container for liquid, to dispose the outer portion of an annular sealing member in that annular recess, and to provide a compressibility for that annular sealing member which enables substantially all of that annular sealing member to be compressed into that annular recess.

The annular sealing member, of the holder provided by the present invention, has an axial dimension which is great enough to avoid substantial axial shifting of the inner face of that annular sealing member relative to the outer face of that annular sealing member as a container is introduced into, or is withdrawn from, the holder of which that annular sealing member is a part. The resulting substantially dimensional stability of that annular sealing member is desirable, because it keeps that annular sealing member from developing and applying undue withdrawal-resisting forces to an container which is inserted within that holder. It is, therefore, an object of the present invention to provide an annular sealing member, for a holder for a container for liquid, that has an axial dimension which is great enough to avoid substantial axial shifting of the inner face of that annular sealing member relative to the outer face of that annular sealing member as a container is introduced into, or is withdrawn from that holder.

A water-resisting cement is used to hold the outer portion of the annular sealing member within the annular recess; and that water-resisting cement leaves substantially all on the bottom and top of that annular sealing member free to move relative to that annular recess. As a result, substantially all portions of that annular sealing member can respond to any compressive forces which are applied to that annular sealing member. This is desirable; because it permits greater radial compression of that annular sealing member than would be possible if that water-resisting cement fixedly secured appreciable portions of the bottom of that annular sealing member to the annular recess. It is, therefore, an object of the present invention to provide a water-resisting cement to hold the outer portion of an annular sealing member within an annular recess while leaving substantially all of the bottom and top of that annular sealing member free to move relative to that annular recess.

The holder, for a container for liquid, which is provided by the present invention has an outside diameter that is small enough to be comfortably held by one hand of a user; and yet that holder is dimensionally stable, provides an annular dead-air space between the inner surface thereof and the surface of even the largest-size container of a given range of containers for liquids, and has all portions thereof able to provide a substantial insulating effect. To enable all portions of that holder to provide such an insulating effect, that holder is made from a cellular material; and hence that holder is made from a material which is relatively weak. To enable that holder to have an outer diameter which is small enough to be comfortably held by one hand of a user—and yet permit that holder to provide an annular dead-air space between the inner surface thereof and the side of the largest-size container of a given range of containers—the wall of the holder must be relatively thin; and hence that wall must be relatively weak. Although made from a material which is relatively weak and although it has a relatively-thin wall, the holder must be dimensionally stable—to maintain a uniform width for the annular dead-air space between the inner surface of that holder and the side of a container held by that holder. Such a uniform width is important in maintaining a uniform amount of insulating effect for all portions of the container which are within the holder; and that uniform width also is important in keeping the circular configuration of the annular sealing member from being distorted to an elliptical configuration—which could permit moisture-laden air to enter the annular dead-air space through gaps adjacent the ends of the major axis of such an elliptical configuration. The holder provided by the present invention is dimensionally stable—even though it is made from a material which is relatively weak and even though it has a relatively-thin wall—because that holder has a thick reinforcing rim adjacent the open end thereof. It is, therefore, an object of the present invention to provide a holder, for a container for liquid, that is made from a material which is relatively weak and which has a relatively-thin wall but that has a thick reinforcing rim adjacent the open end thereof which makes that holder dimensionally stable.

Other and further objects and advantages of the present invention should become apparent from an examination of the drawing and accompanying description.

In the drawing and accompanying description, a preferred embodiment of the present invention is shown and described but it is to be understood that the drawing and accompanying description are for the purpose of illustration only and do not limit the invention and that the invention will be defined by the appended claims.

DETAILED DESCRIPTION OF PREFERRED EMBODIMENT

Figure 1:
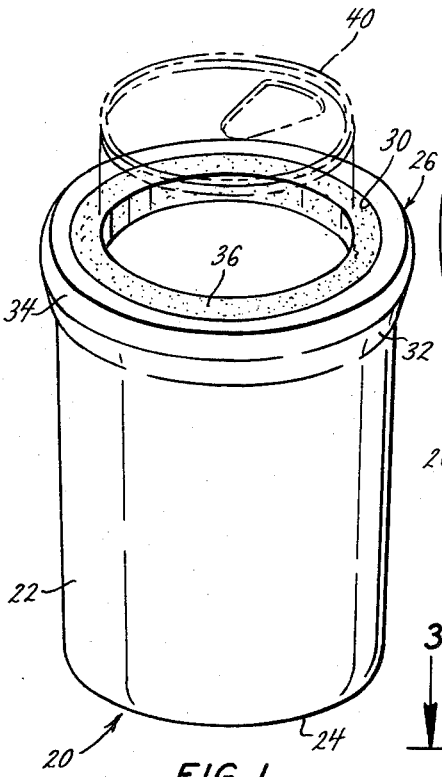
FIG. 1 is a perspective view of one preferred embodiment of holder, for a container for liquid, which is made in accordance with the principles and teaching of the present invention; and it shows the upper portion of a container, held by that holder, by dotted lines.
Figure 3:
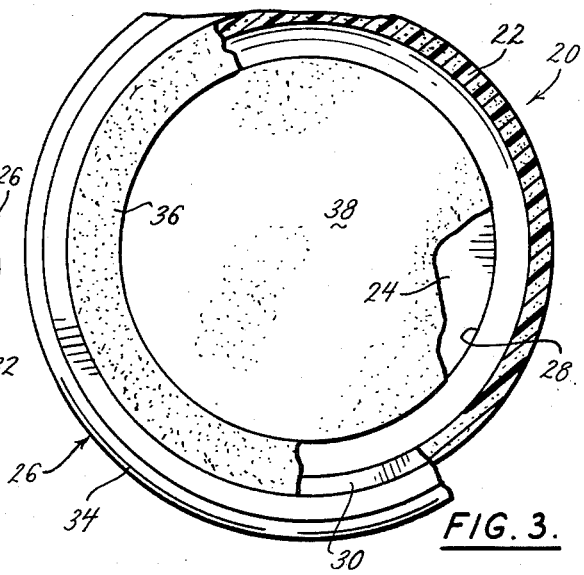
FIG. 3 is a sectional view on the scale of FIG. 2 which is taken along a broken plane indicated by the broken line in FIG. 2.

Referring to the drawing in detail, the numeral 20 generally denotes one preferred embodiment of holder that is made in accordance with the principles and teachings of the present invention. That holder has an annular wall 22 and a bottom 24 which coact to define a closed-bottom, open-top, substantially-cylindrical recess. The outer surface of the major portion of the wall 22 preferably is cylindrical; but the inner surface of that wall has sufficient draft to facilitate the ready release of the holder from the mold on which it is formed.

The numeral 26 generally denotes a rim which is adjacent the upper end of the wall 22; and that rim projects laterally outwardly beyond all other portions of the holder 20. A circular recess 28 is formed in the upper surface of the bottom 24; and the diameter of that recess is appreciably smaller than the smallest inner diameter of the wall 22. An annular recess 30 is provided in the wall 22 adjacent the upper end of that wall; and that annular recess is, at least in part, in axial registry with the rim 26.

The lower portion of the rim 26 is denoted by the numeral 32, and it is generally conical in configuration. The upper portion of the rim 26 is denoted by the numeral 34; and it is generally spherical in configuration. The generally-conical configuration of the lower portion 32 provides a gentle, but pronounced, increase in diameter which rapidly increases the cross section of the wall 22 adjacent the open end of the holder 20; and thereby strengthens that open end and also resists any tendency of that holder to slip downwardly relative to the hand of a person holding that holder. The generally-spherical configuration of the upper portion 34 provides a gentle, but pronounced, increase in the thickness of the wall 22 adjacent the upper end of the holder; and thereby strengthens that open end while providing a surface which would not cause discomfort to the lips of a user in the event the user's lips accidentally touched that surface.

The numeral 36 denotes an annular sealing member which is disposed within the annular recess 30. That annular sealing member is dimensioned so it must experience a slight radial compression to enable it to fit within the annular recess 30. A thin coating of water-resistant cement is interposed between the cylindrical outer surface of that annular sealing member and the adjacent wall of the annular recess 30; but substantially no water-resistant cement is interposed between the bottom surface of that annular sealing member and the bottom of that annular recess. As a result, that water-resistant cement will hold the annular sealing member within the annular recess 30 but will permit substantially all portions of that annular sealing member to move relative to that annular recess. Whenever the holder 20 is not holding a container for liquid, the annular sealing member 36 will have the inner surface thereof spaced well inwardly of the inner surface of the wall 22; and that inner surface will define a circular opening which has a diameter that is no larger than the diameter of the smallest size container in a given range of containers.

The numeral 38 denotes a circular pad which has the lower portion thereof disposed within the circular recess 28 in upper surface of the bottom 24. A thin layer of water-resistant cement is interposed between the side of that pad and the side of that recess to secure that pad in position within that recess. The pad 38 is dimensioned so its unstressed axial dimension is greater than the axial dimension of the recess 28.

The interposing of the water-resistant cement between the wall of recess 28 and the side of pad 38 provides a stiffening effect for that pad. As a result, that pad is able to hold the bottom of the container 40 above, and out of engagement with, the bottom 24—unless a person applies a continuing downwardly-directed force to that container after the pad 38 initially checks the inward movement of that container.

The numeral 40 generally denotes a container, for liquid, which is intended to be telescoped into, and to be held by, the holder 20. That container can be any one of a number of standard and usual metal containers which are commonly used for beer, soft drinks, fruit juices, and other comestibles. That container will usually have a diameter ranging from two and seven-sixteenths (2 7/16 ) inches to two and nine-sixteenths (2 9/16) inches.

The wall 22, the bottom 24, and the rim 26 preferably are molded as a unitary molding from a cellular material; and hence that holder 20 will preferably be unitary and homogeneous in nature. Although different cellular materials could be used in making the holder 20, one of the polystyrenes which are sold under the trademark DYLITE is preferred. That particular polystyrene has a density of two and one-half (2.5) pounds per cubic feet, has a tensile strength of seventy-five (75) pounds per square inch, has a flexural strength of one hundred and twenty (120) pounds per square inch, has a shear strength of forty-five (45) pounds per square inch, requires a compressive force of at least forty (40) pounds per square inch before any deformation thereof can reach a five percent (5%) value, and has a thermal conductivity of less than twenty-four hundred and twenty-five ten-thousandths (0.2425) BTU per inch of thickness per hour per square foot per Fahrenheit degree of temperature differential. Although that particular polystyrene is a relatively-weak material, it is stronger than most polystyrenes which are used for insulating purposes; and the rim 26 strengthens the open end of the holder 20 to the point where that holder is dimensionally stable even when gripped by the hand of a user.

The annular sealing member 36 preferably is made from an open-cell material; and some of the materials which can be used in making the annular sealing member are polyester urethanes and polyether urethanes. If desired, a low-permeability urethane or a Scott industrial foam could be used in making the annular sealing member.

A preferred polyester urethane has a density of one and thirty-five hundredths (1.35) pounds per cubic foot and has an indentation load deflection rating in the range of thirty-six to forty-four (36–44). However, it would be possible to use a cellular material which had density and indentation load deflection ratings which ranged from one (1) pound per cubic foot density and thirty-three to forty-one (33–41) indentation load deflections to two (2) pounds per cubic foot density and forty to fifty (40–50) indentation load deflections. That preferred polyester urethane has a collapse ratio of at least three to one (3:1) with as little as one (1) pound per square inch pressure.

The preferred polyester urethane will keep water from leaking through it, and it will be capable of absorbing water to the extent that each of the annular sealing member 36 and the pad 38 can absorb one and one-half ($1\frac{1}{2}$) ounces of water. The fact that the preferred polyester urethane will keep water from leaking through it is important, because it will enable the annular sealing member to keep any water within the holder 20 from dripping onto the clothing of a person drinking from a container which is held by that holder. The fact that the preferred polyester urethane absorbs water is desirable; because it enables that annular sealing member to absorb and hold substantially all of the condensate and water on the side of the container 40, as that annular sealing member wipes off that condensate and water in squeegee-like fashion while the lower end of that container is being telescoped into the holder 22. Also, the water-absorbing capability of the pad 38 is desirable; because it enables that pad to hold all of the condensate which could form on the side of the container 40 while the lower end of that container was within the holder 20.

The recess 28 in the upper surface of the bottom 24 performs several functions. Specifically, it centers the pad 38, it limits the extent to which the upper surface of that pad projects above the upper surface of that bottom, and it acts as a sump for water absorbed by that pad.

The preferred polyester urethane has a relatively-low component of frictional resistance. For example, where the normal inner diameter of the annular sealing member 36 is two and seven-sixteenths (2 7/16) of an inch, and where the lower end of a container with a diameter of two and nine-sixteenths (2 9/16) of an inch is telescoped into the holder 20, a mere sixteen (16) ounce force was able to move that container relative to that annular sealing member. Such a relatively-low component of frictional resistance is very desirable; because it minimizes the axial-distorting forces which the container 10 can apply to the inner surface of the annular sealing member 36 as the lower end of that container is inserted into, or is withdrawn from, the holder 20.

The preferred form of annular sealing member 36 is one-half ($\frac{1}{2}$) of an inch in height; and it has an unstressed thickness of one-half ($\frac{1}{2}$) of an inch. The thickness of that annular sealing member will, after that annular sealing member has been positioned within the annular recess 30, be about three-eighths ($\frac{3}{8}$) of an inch. The mass of that annular sealing member is great enough to enable that annular sealing member to resist appreciable axial shifting of the inner surface thereof relative to the outer surface thereof, as the lower end of the container 40 is inserted into, or is withdrawn from, the holder 20—even though that annular sealing member has a compressibility which enables substantially all of the annular sealing member to be compressed within the one-eighth ($\frac{1}{8}$) inch width of the annular recess 30 by as small a pressure as one (1) pound per square inch. The resistance of the annular sealing member to distortion in the radial direction is very desirable; because such resistance always enables that annular sealing member to initially provide, and thereafter maintain, a cylindrical surface to cylindrical surface engagement with the confronting portion of the side of any container held by the holder 20. That cylindrical surface to cylindrical surface engagement will enable that annular sealing member to wipe from the side of the container any condensate or water thereon, will substantially prevent the entry of air into the annular dead-air space between the inner surface of the wall 22 and the side of the container, and will avoid the development of any increased withdrawal-resisting forces.

It would be possible to reduce the axial dimension of the annular sealing member 36 to some extent while still enabling the mass of that annular sealing member to be great enough to resist appreciable axial shifting of the inner surface of that annular sealing member relative to the outer surface of that annular sealing member. However, that axial dimension should not be reduced below one-quarter ($\frac{1}{4}$) of an inch; because such a short axial dimension could not resist appreciable axial shifting of the inner surface of the annular sealing member relative to the outer surface of that annular sealing member. Also, such a short-length annular sealing member would provide less insulative effect per square inch thereof than would the wall 22. Moreover, such a short-length annular sealing member could not absorb and hold one and one-half ($1\frac{1}{2}$) ounces of water.

The pad 38 is formed at the same time the annular sealing member 36 is formed. Also, that pad preferably is cut from the same sheet of cellular material from which the annular sealing member 36 is cut.

The wall 22 of the holder 20 preferably has a thickness of five thirty-seconds (5/32) of an inch; and hence that wall thickness is greater than one-eighth ($\frac{1}{8}$) of an inch the width of the annular recess 30. The bottom 24 has a thickness of one half ($\frac{1}{2}$) of an inch, and the recess 28 has a depth of five thirty-seconds (5/32) of an inch. Consequently, the top of the one-half ($\frac{1}{2}$) inch thick pad 38 projects about five thirty-seconds (5/32) of an inch above the upper surface of the bottom 24.

The annular recess 30 has a depth of one-half ($\frac{1}{2}$) of an inch. As a result, the top of the one-half ($\frac{1}{2}$) inch thick annular sealing member 36 is flush with the top of the generally-spherical upper portion 34 of the rim 26.

The axial distance from the top of the holder 20 to the junction between the generally-spherical upper portion 34 and the generally-conical lower portion 32 of the rim 26 is about one-quarter ($\frac{1}{4}$) of an inch. The outer diameter of the wall 22 is three and three-sixteenths (3 3/16) inches. The largest diameter of the rim 26 is three and three-quarters ($3\frac{3}{4}$) inches.

Because all portions of the wall 22, all portions of the bottom 24, and all portions of the rim 26 are made from cellular material, all of those portions contribute significantly to the important insulative effect of the holder 20. Because the inner diameter of the wall 22 averages at least two and seven-eights (2 7/8) inches, an annular dead-air space will be provided between the inner surface of that wall and the side of each container having a diameter in the range of two and seven-sixteenths to two and nine-sixteenths (2 7/16–2 9/16) inches. That annular dead-air space will provide an insulative effect which is in addition to the insulative effects provided by wall 22, the holder 24 and the annular sealing member 36. As a result, the holder 20 provides a very desirable insulative effect.

The relatively massive rim 26 makes the open end of the holder 20 dimensionally stable. The resulting uniform width of the annular dead-air space surrounding the container 40 will provide a uniform insulative effect completely around the lower portion of that container. Also, because the open end of the holder 20 is dimensionally stable, the annular sealing member 36 will provide a continuous, uniform and uninterrupted pressure against the side portion of the container 40. As a result, little or no moisture-laden air can enter the annular space and no water can escape from that annular space and drip onto the clothing of a person drinking from the container—as could happen if the upper end of the wall 22 were to be dimensionally unstable and were to respond to gripping pressure to become distorted from its normal circular annular configuration to an ovate configuration so moisture-laden air could pass inwardly through, or water could leak out through gaps adjacent the opposite ends of the major axis of the elliptically-distorted annular sealing member.

The rim 26 performs an additional, very desirable function; namely, it enables the holder 20 to be easily held down by a person's side by that person's fingertips. It can be tiresome to hold one's forearm essentially horizontal to keep a container of liquid from tipping; but a forearm which holds most prior holders for containers for liquid must be held essentially horizontal. A person who wants to hold the holder of the present invention need not do so with a horizontally-extended forearm. Instead, that person can hold that holder down by his or her side by the tips of his or her downwardly-extending fingers. As a result, the rim 26 makes the holder of the present invention far more versatile than most prior holders for containers for liquid.

The highly-compressible nature of the annular sealing member 36 and the presence of the annular recess 30 enable the holder 20 to accept and hold the lower ends of bottles and of glasses which have diameters considerably larger than two and nine-sixteenths (2 9/16) inches. In fact, the highly-compressible nature of the annular sealing member and the presence of that annular recess enable the holder 20 to accept and hold the lower ends of bottles and of glasses which have diameters that closely approach two and seven-eighths (2 7/8) inches. Even when the lower ends of such bottles and glasses are inserted into, and are withdrawn from, the holder 20, the withdrawing-resisting forces which are developed by the annular sealing member 36 are relatively small. As a result, the holder 20 can be used to hold the lower ends of relatively large bottles and glasses.

A number of glass bottles and containers have ripples, ridges or other aplanar surface elements on the exteriors thereof. Each of those surface elements could cause a plural-finger annular cap for a holder to leave one or more gaps through which moisture-laden air could enter the annular air space between the inner surface of that holder and the exterior of the container; and all such gaps would be objectionable. The readily-compressible annular sealing member 36 does not leave any such gaps; because it readily yields to fully conform to and to intimately engage any such ripples, ridges, or other aplanar surface elements.

The pad 38 provides a direct insulative effect for the bottom of the container 40. Also, that pad holds the sides of that bottom up and away from the sides of the bottom 24 of the holder 20, and thereby provides an additional insulative effect for the bottom of that container.

Figure 2:
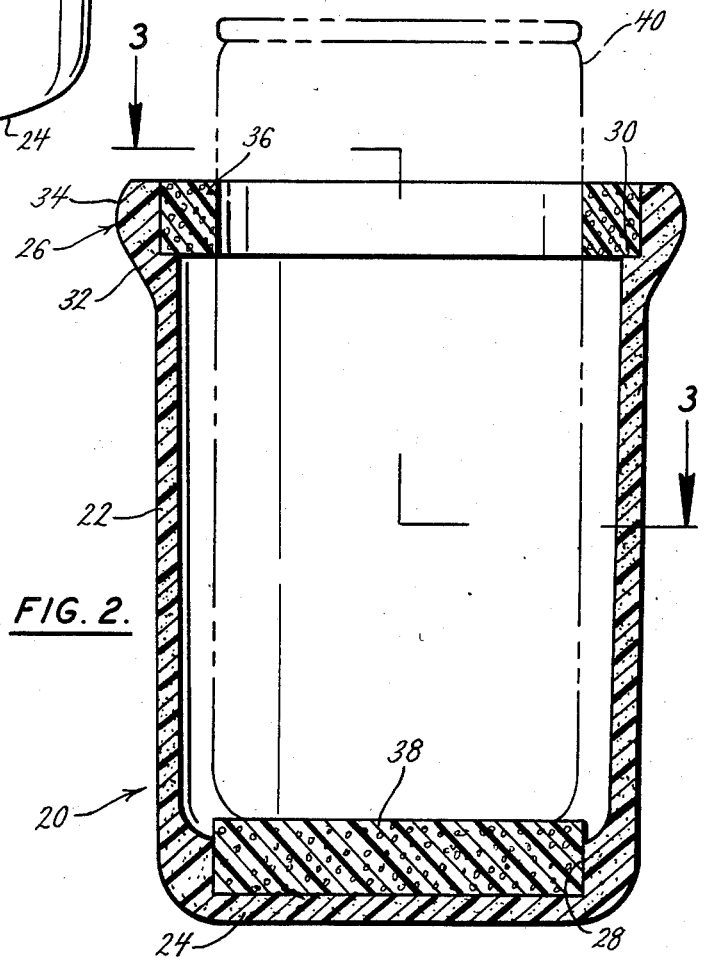
FIG. 2 is a vertical section, on a larger scale, through the holder of FIG. 1; and it shows a container, held by that holder, by dotted lines.

The insulative effect of the pad 38 coacts with the insulative effect of the wall 22 and bottom 24, with the insulative effect of the annular sealing member 36, and with the insulative effect of the annular dead-air space surrounding the container 40 to provide a combined insulative effect which has never before been provided by a holder for a container for beer, soft drinks, fruit juices or other comestibles. For example, when such a container and its contents were cooled for several hours to forty-eight degrees Fahrenheit (48° F.) and then were disposed within the holder 20 in the manner shown by dotted lines in FIGS. 1 and 2, and when that holder and container were disposed for one-half ($\frac{1}{2}$) of an hour within a chamber wherein the temperature was held at one hundred degrees Fahrenheit (100° F.), the temperature of that container and its contents increased by a mere six and one-half degrees Fahrenheit (6.5° F.). In contrast, when a similarly-cooled container and its contents were disposed within a commercially-available holder which has a polystyrene wall and bottom but has a plural-finger, container-engaging, annular cap for the upper end thereof, and when that holder and that container were disposed for one-half ($\frac{1}{2}$) of an hour within that chamber and the temperature was held at one hundred degrees Fahrenheit (100° F.), the temperature of that container and its contents increased by seven and one-half degrees Fahrenheit (7.5° F.). When a similarly-cooled container and its contents were disposed for one-half ($\frac{1}{2}$) of an hour within that chamber without having any portion of that container inserted into a holder, and when the temperature in that chamber was held at one hundred degrees Fahrenheit (100° F.), the temperature of that container and its contents increased by fifteen degrees Fahrenheit (15° F.). When yet another similarly-cooled container and its contents were disposed within a holder 20 from which the annular sealing member 36 had been removed, and when that holder and container were disposed for one-half (½) of an hour within that chamber while the temperature was held at one hundred degrees Fahrenheit (100° F.), the temperature of that container and its contents increased by seven and one-quarter degrees Fahrenheit (7.25° F.).

From all of the foregoing, it should be apparent that the holder of the present invention (a) has an outer diameter which is small enough to enable that holder to be gripped comfortably by a person's hands, (b) has a wall of cellular material which provides a highly-desirable insulative effect, (c) provides an annular dead-air space between the inner surface thereof and the confronting side of a container held therein to provide an additional highly-desirable insulative effect, (d) has a dimensionally-stable open end so the annular sealing member can retain its annular circular configuration and not be distorted to an elliptical configuration by gripping pressure, (e) provides a uniform, continuous and uninterrupted sealing action with the side of each inserted container, (f) can accommodate a range of containers of different sizes, and (g) can easily be held down by a person's side by the tips of the person's downwardly-extending fingers. Further, it should be apparent that the annular sealing ring will resist any axial shifting of the inner surface thereof relative to the outer surface thereof as a container is telescoped inwardly or outwardly of the recess defined by the holder. Moreover, by maintaining its axial stability and configuration, the annular sealing member does not develop or apply undue withdrawal-resisting forces, which could tend to make it difficult to withdraw a container from the holder.

Whereas the drawing and accompanying description have shown and described a preferred embodiment of the present invention, it should be apparent to those skilled in the art that various changes may be made in the form of the invention without affecting the scope thereof.

What we claim is:

1. An insulating holder, for releasably holding a container for liquid, which comprises an elongated, annular, side wall and a bottom that coact to define an elongated, generally-cylindrical recess which has an inner diameter that is larger than the diameter of said container, an axial dimension that is shorter than the axial dimension of said container, and an open end through which the container is insertable into said recess, an annular sealing member of a resiliently-compressible cellular material disposed upon said side wall at an upper end portion thereof for sealing against a confronting portion of the container, a sump recessed formed in the bottom wall of the container, said sump recess having a peripheral wall of a lesser diameter than the inner diameter of the side wall of the holder and opening into the generally cylindrical recess, a pad of resiliently compressible cellular material, a lower end of said pad being disposed in said sump recess and an upper portion thereof projecting upwardly from the sump recess into the generally cylindrical recess, and a water-resistent cement applied about the periphery of said pad in a manner securing the pad to the peripheral wall of the sump recess, said cement serving as a means for stiffening the pad sufficiently to enable the pad to hold the bottom of the container above, and out of engagement with, the bottom of the holder, thereby enabling condensate traveling down the container to be effectively absorbed by the pad and collected in said sump recess.

2. An insulating holder as claimed in claim 1 wherein a rim is formed on the outer surface of said elongated, annular, side wall adjacent said open end of said elongated, generally-cylindrical recess, wherein said rim projects radially outwardly beyond adjacent portions of said outer surface of said elongated annular side walls, wherein an annular recess is provided in said side wall to accommodate said annular sealing member, and wherein said rim is, at least in part, axially in register with said annular recess to make the distance between said wall of said annular recess and the outer surface of said rim substantially greater than the thickness of said elongated, annular, side wall.

3. An insulating holder as claimed in claim 1 wherein an annular recess is provided in said side wall to accomodate said annular sealing member, wherein said annular recess has a radial dimension close to the thickness of said side wall, and wherein substantially all portions of said annular sealing member can be compressed into said annular recess.

* * * * *